US010844312B2

(12) United States Patent
Greaves et al.

(10) Patent No.: US 10,844,312 B2
(45) Date of Patent: Nov. 24, 2020

(54) LUBRICANT COMPOSITION

(71) Applicant: Dow Global Technologies LLC, Midland, MI (US)

(72) Inventors: Martin R. Greaves, Baar (CH); Evelyn A. Zaugg-Hoozemans, Richterswil (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/310,310

(22) PCT Filed: Jun. 20, 2017

(86) PCT No.: PCT/US2017/038240
§ 371 (c)(1),
(2) Date: Dec. 14, 2018

(87) PCT Pub. No.: WO2017/223030
PCT Pub. Date: Dec. 28, 2017

(65) Prior Publication Data

US 2019/0345408 A1 Nov. 14, 2019

Related U.S. Application Data

(60) Provisional application No. 62/354,292, filed on Jun. 24, 2016.

(51) Int. Cl.

| | |
|---|---|
| ***C10M 169/04*** | (2006.01) |
| ***C10M 161/00*** | (2006.01) |
| *C10N 30/10* | (2006.01) |
| *C10N 40/08* | (2006.01) |
| *C10N 40/25* | (2006.01) |
| *C10N 40/04* | (2006.01) |

(52) U.S. Cl.
CPC ..... *C10M 169/044* (2013.01); *C10M 161/00* (2013.01); *C10M 2203/1006* (2013.01); *C10M 2205/0285* (2013.01); *C10M 2207/026* (2013.01); *C10M 2207/289* (2013.01); *C10M 2209/1055* (2013.01); *C10M 2209/1065* (2013.01); *C10M 2219/082* (2013.01); *C10M 2221/043* (2013.01); *C10N 2030/10* (2013.01); *C10N 2040/042* (2020.05); *C10N 2040/08* (2013.01); *C10N 2040/25* (2013.01)

(58) Field of Classification Search
CPC ..... C10M 169/044; C10M 161/00; C10M 2203/1006; C10M 2205/0285; C10M 2207/026; C10M 2207/289; C10M 2209/1055; C10M 2209/1065; C10M 2219/082; C10M 2221/043; C10N 2230/10; C10N 2240/042; C10N 2240/08; C10N 2240/10
See application file for complete search history.

(56) References Cited

U.S. PATENT DOCUMENTS

| | | | | |
|---|---|---|---|---|
| 2,518,245 | A | 8/1950 | Morris et al. | |
| 2,562,144 | A * | 7/1951 | Harman | C10M 1/08 508/482 |
| 3,005,853 | A | 10/1961 | Wilgus et al. | |
| 3,135,804 | A * | 6/1964 | Von Brachel | C08G 65/34 568/45 |
| 4,894,174 | A * | 1/1990 | Salomon | C10M 135/24 252/77 |
| 5,051,198 | A * | 9/1991 | Salomon | C10M 135/24 252/78.1 |
| 5,856,280 | A | 1/1999 | Kim et al. | |
| 5,994,277 | A | 11/1999 | Ritchie et al. | |
| 6,806,241 | B2 | 10/2004 | Karol et al. | |
| 7,494,960 | B2 | 2/2009 | Migdal et al. | |
| 8,093,190 | B2 | 1/2012 | Chase et al. | |
| 8,901,060 | B2 | 12/2014 | Fasbender | |
| 2006/0009366 | A1 * | 1/2006 | Sant | C10M 129/10 508/563 |
| 2014/0045736 | A1 | 2/2014 | Crawley et al. | |
| 2014/0213493 | A1 | 7/2014 | Chase et al. | |

FOREIGN PATENT DOCUMENTS

| | | |
|---|---|---|
| EP | 0896050 | 2/1999 |
| WO | 88/09366 | 12/1988 |
| WO | 2017031162 | 2/2017 |

OTHER PUBLICATIONS

International Search Report & Written Opinion for related PCT Application PCT/US2017/038240, dated Aug. 25, 2017 (13 pgs).
International Preliminary Report on Patentability for related PCT Application PCT/US2017/038240, dated Jan. 3, 2019 (9 pgs).

* cited by examiner

*Primary Examiner* — Cephia D Toomer
(74) *Attorney, Agent, or Firm* — Brooks, Cameron & Huebsch, PLLC

(57) ABSTRACT

An antioxidant package composition including a combination of: (i) at least one hindered phenolic antioxidant, and (ii) at least one polyether sulphide; a lubricant composition including: (a) the antioxidant package composition and (b) at least one base oil; a process for preparing the antioxidant package composition; and a process for preparing the lubricant composition.

17 Claims, No Drawings

LUBRICANT COMPOSITION

This application is a National Stage Application under 35 U.S.C. § 371 of International Application Number PCT/US2017/038240, filed Jun. 20, 2017 and published as WO 2017/223030 on Dec. 28, 2017, which claims the benefit to U.S. Provisional Application 62/354,292, filed Jun. 24, 2016, the entire contents of which are incorporated herein by reference in its entirety.

FIELD

The present invention is related to a lubricant composition including a base oil which contains a hindered phenolic anti-oxidant and a polyether sulphide. More specifically, the present invention relates to a lubricant composition that includes a polyether sulphide (S-PAG) which can boost the anti-oxidant performance of the hindered phenolic anti-oxidant present in the lubricant composition.

BACKGROUND

Most industrial and automotive lubricants contain an anti-oxidant or a combination of anti-oxidants to extend the lubricants' useful operating life. In some applications, such as automotive engine oils, there is a need for lubricants to perform under high thermal stresses where the lubricant can experience temperatures of for example 250 degrees Celsius (° C.) or higher. In addition, lubricants having longer drain intervals are desired. Currently for example, oil drain intervals for passenger cars using current motor oils require a drain interval every 3 to 6 months over the life time of the automobile. One potential technical solution to extending the life or oil drain intervals of a lubricant is to develop new anti-oxidants useful in lubricants or to develop combination of current commercial anti-oxidants with other materials that provide a synergistic performance in extending oil drain intervals.

Heretofore, the most common type of anti-oxidants used in lubricants is alkylated diphenylamines (ADPA). Another type of anti-oxidants used in lubricants is hindered phenolic anti-oxidants. Both of these types of anti-oxidants are often described as "free radical scavengers". Combinations of free radical scavengers (such as an aminic and a phenolic) are known. Another class of anti-oxidants are "peroxide decomposers". The peroxide decomposer class of anti-oxidants' mode of action is very different to the mode of action of free radical scavengers. The action of the peroxide decomposers is to reduce the alkyl hydroperoxides to alcohols. These hydroperoxides form from the radical decomposition of the lubricant base oil. In this way peroxide decomposers are consumed in a sacrificial manner. Conventional peroxide decomposers include sulphur-containing organometallic materials such as molybdenum dialkyldithiocarbamates (MoDTC) and zinc dialkyldithiophosphates (ZDDP). Combinations of a free radical scavenger with a peroxide decomposer are also known such as combinations of ADPA and MoDTC.

The primary use of organometallic-based peroxide decomposers is as surface active materials and not as anti-oxidants. MoDTC is used primarily as a friction modifier. ZDDPs are used primarily as anti-wear additives. Because MoDTCs and ZDDPs are surface active and chemically react with surfaces to form films, these compounds are consumed over time. The effectiveness of peroxide decomposers as anti-oxidants over time becomes redundant.

The lubricant industry is trending away from using metal-containing lubricants. Thus, ash-free dialkyldithiocarbamates have been researched as an alternative to MoDTC but such dialkyldithiocarbamates, when used in hydrocarbon oils, are much less effective than MoDTC and can leave deposits on surfaces of lubrication equipment which, in turn, can impact wear of the lubrication equipment.

It would be an advantage in the lubricant industry to prepare a lubricant composition that includes an antioxidant package containing an anti-oxidant booster that enhances the anti-oxidant performance of the anti-oxidants and extends the life of the lubricant.

SUMMARY

In one embodiment, the present invention is directed to an antioxidant package, which comprises a combination of a polyether sulphide compound and a hindered phenolic anti-oxidant compound. For example, in one embodiment, the antioxidant package of the present invention includes a combination of (i) at least one hindered phenolic anti-oxidant such as benzene propanoic acid, 3,5-bis(1,1-dimethylethyl)-4-hydroxy-,C7-9-branched alkyl ester, and (ii) at least one polyether sulphide such as an alkoxylate of bis(2-hydroxyethyl) sulphide.

The antioxidant package can be used in a lubricant composition such that the antioxidant package provides a remarkable synergistic performance or effect in extending the life of the lubricant composition. Thus, in another embodiment, the present invention is directed to a lubricant composition containing the above antioxidant package. For example, the lubricant composition of the present invention includes: (a) a base oil, (b) at least one hindered phenolic, and (c) at least one polyether sulphide. The polyether sulphide compound (herein "S-PAG") useful in the lubricant of the present invention provides a boost to the anti-oxidant performance of the hindered phenolic present in the lubricant of the present invention.

Other embodiments of the present invention include a process for preparing the antioxidant package; a process for preparing the lubricant composition containing the antioxidant package; and a process for using the lubricant composition or formulation as an automotive engine oil.

DETAILED DESCRIPTION

"Base oils" herein means oils that include both natural oils and synthetic oils. Natural and synthetic oils can be used in the present invention unrefined, refined, or re-refined. The American Petroleum Institute (API) has defined/classified base oils into several categories ("Groups") such as Groups I, II, III, IV and V to create guidelines for lubricant base oils. Group I base stocks generally have a viscosity index of greater than or equal to (≥) 80 to less than (<) 120 and contain greater than (>) 0.03 percent (%) sulfur and <90% saturates. Group II base stocks generally have a viscosity index of ≥80 to less than <120, and contain less than or equal to (≤) 0.03% sulfur and ≥90% saturates. Group Ill base oils generally have a viscosity index ≥120 and contain ≤0.03% sulfur and ≥90% saturates. ASTM D2270 is used to calculate viscosity index. Group IV base oils include polvalphaolefins (PAO). Group V base stocks include base stocks not included in Groups I-IV. For example, Group V base oils may include polyalkylene glycols, synthetic esters, polyisobutylenes, phosphate esters, and the like. The following table summarizes properties of each of the aforementioned five Groups of base oils.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II III or IV | | |

An "antioxidant" herein means a component that assists in reducing the rate of oxidation of a base oil or a lubricant composition.

A "useful operating life", with reference to a lubricant, herein means a lubricant having the desired functionality to be successfully used in equipment for a desired period of time.

An "antioxidant package" herein means a mixture of two or more components of which at least one component is an anti-oxidant. Other components useful in the antioxidant package may include, for example, one or more of the following compounds or additives:

other anti-oxidants, corrosion inhibitors, viscosity index modifiers, detergents, anti-wear agents, extreme pressure additives and solvents that can aid in maintaining the package homogenous during storage and handling.

The antioxidant package of the present invention includes an antioxidant component that can boost the anti-oxidant performance of antioxidants when combined with such antioxidants such as alkylated diphenyl amines (ADPA) or hindered phenolics; and that can resist being consumed as surface active materials. In addition, the antioxidant package of the present invention offers a better cleanliness benefit than metal free dialkyldithiocarbamates. It is known that as lubricants age, the lubricants can form deposits which impact wear in lubrication equipment; and thus, lubricants with better cleanliness are desired. For example, polyether backbones in some additives can provide a high level of cleanliness. Functionalized polyethers (such as S-PAGs) can provide both enhanced cleanliness and the ability to boost the performance of antioxidants.

One broad embodiment of the present invention includes an antioxidant package useful as an antioxidant agent for a lubricating oil. For example, the antioxidant package includes a combination of: (i) at least one hindered phenolic antioxidant, and (ii) at least one polyether sulphide.

In preparing the antioxidant package of the present invention, a first required component (i) includes at least one hindered phenolic antioxidant compound. For example, the chemical structure of a broad class of hindered phenolic antioxidant compounds is shown in the formula of Structure (I) as follows:

Structure (I)

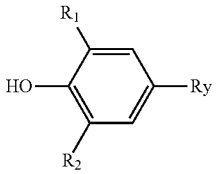

In the above Structure (I), $R_1$ and $R_2$, independently, may each be an alkyl radical having from C3 to C9 carbons; and Ry can be an alkyl radical having from C1 to C30 carbons, an alkyl radical containing a carboxy group (COO) or an alkyl radical containing a thio group (—S—).

For example, some specific embodiments of Structure (I) are shown in the following Structures (II) and (III), wherein n and m are each integers from 1 to 4; and $R_3$ is an alkyl group having from 1 to 30 carbons.

Structure (II)

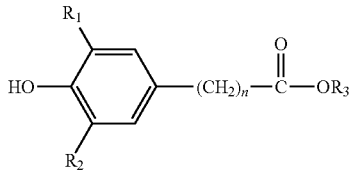

Structure (III)

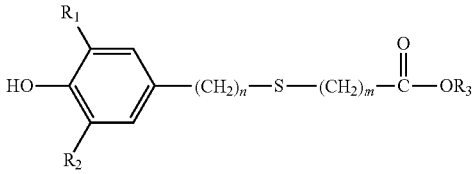

Examples of $R_1$ and $R_2$ in the above Structures (II) and (III) are when $R_1$ and $R_2$ can be tertiary butyl radicals.

Higher molecular weight hindered phenolic compounds represented by Structures (IV) and (V) can also be used such as those shown in Structures (IV) and (V) where $R_1$ and $R_2$ can be alkyl radicals from 3 to 9 carbons; and n and m are each, individually and separately, integers from 1 to 4. These higher molecular weight hindered phenolic compounds are advantageously useful in applications where the lubricant experiences high temperatures. Higher molecular weight phenolics are typically less volatile. Examples of $R_1$ and $R_2$ are when $R_1$ and $R_2$ are tertiary butyl radicals.

Structure (IV)

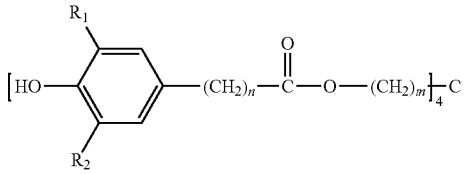

Structure (V)

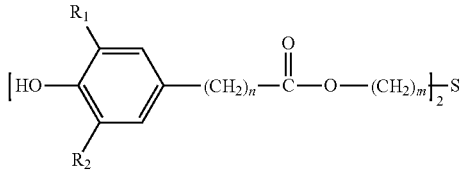

The at least one hindered phenolic antioxidant compound, component (i), of the present invention can include any hindered phenolic antioxidant compound within the scope of Structure (I) above. For example, the hindered phenolic antioxidant compound of Structure (I) may include those compounds in which each $R_1$ and $R_2$, individually and separately, are C3 to C9.

Commercially available products which are included in Structure (I) and which are useful in the present invention may include for example, commercial products sold under the trade name IRGANOX™ which are available from BASF. In one embodiment, the hindered phenolic antioxidant can be IRGANOX L135 a compound commercially available from BASF. IRGANOX L135 is an anti-oxidant and can be defined as benzene propanoic acid, 3,5-bis(1,1-dimethylethyl)-4-hydroxy-,C7-9-branched alkyl ester (CAS No. 125643-61-0).

The chemical structure of IRGANOX L135 is shown in the formula of Structure (VI) as follows:

Strucure (VI)

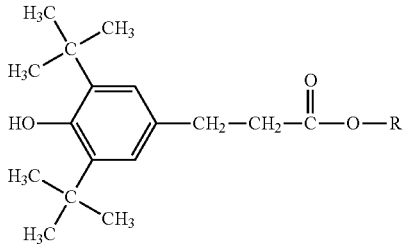

Other embodiments of the hindered phenolic antioxidant useful in the present invention can include for example the following commercially available compounds: IRGANOX 1076, IRGANOX 1010, butylated hydroxytoluene (BHT), and mixtures thereof.

IRGANOX 1076 is octadecyl-3-(3,5-di-tert.butyl-4-hydroxyphenyl)-propionate (CAS No. 6683-19-8). The chemical structure of IRGANOX 1076 is shown in the formula of Structure (VII) as follows:

Structure (VII)

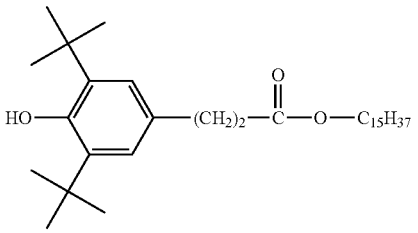

IRGANOX 1010 is pentaerythritol tetrakis(3-(3,5-di-tert-butyl-4-hydroxyphenyl)propionate) and CAS No. is 6683-19-8. The molecular weight of IRGANOX 1010 is 531 g/mol. The chemical structure of IRGANOX 1010 is shown in the formula of Structure (VIII) as follows:

Structure (VIII)

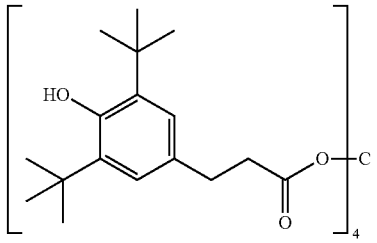

The chemical structure of butylated hydroxytoluene (BHT) is shown in the formula of Structure (IX) as follows:

Structure (IX)

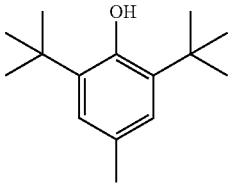

The concentration of the hindered phenolic antioxidant, component (i), present in the antioxidant package of the present invention may range generally from about 1 weight percent (wt %) to about 99 wt % in one embodiment, from about 5 wt % to about 80 wt % in another embodiment, from about 5 wt % to about 50 wt % in another embodiment, from about 50 wt % to about 80 wt % in another embodiment, and from about 10 wt % to about 20 wt % in still another embodiment based on the total weight of the components in the antioxidant package.

The hindered phenolic antioxidant, component (i), provides the antioxidant package of the present invention with several benefit(s) including, for example, the functionality of the hindered phenolic to act as an anti-oxidant, to improve the thermo-oxidative stability of the base oil, and to extend the base oil's useful operating life by extending oil drain intervals.

In preparing the antioxidant package of the present invention, a second required component (ii) includes at least one polyether sulphide compound (e.g., S-PAG). The at least one polyether sulphide compound, component (ii), of the present invention can be any conventional polyether sulphide compound. For instance, general examples of component (ii) may include one or more of polyethers containing a sulphur group; disulphides; sulphur compounds having a sulphur group in oxidation state II, IV or VI; and mixtures thereof. In one embodiment, the sulphur compound is a compound having a sulphur group in oxidation state II. When polymers have sulphur groups in oxidation state IV, the polymers are known as polyether sulphoxides and the sulphur is bonded to an oxygen atom and two carbons atoms from the polyether fragments. When polymers have sulphur in oxidation state VI, the polymers are known as polyether sulphones and the sulphur is bonded to two oxygen atoms and two carbon atoms from the polyether fragments. Polyether sulphoxides and polyether sulphones can function as antioxidant boosters for the hindered phenolic antioxidant.

In one embodiment, specific examples of the polyether sulphide compound, component (ii), can be for example one or more S-PAGs which are a broad class of polyethers containing sulphur. For example, in one embodiment, the S-PAGs useful as component (ii) are alkoxylates of thiodiglycol also known as bis(2-hydroxyethyl) sulphide, and 2,2'-thiodiethanol, and mixtures thereof. Other bis(2-hydroxyalkyl) sulphides useful in the present invention may include for example bis(2-hydroxypropyl) sulphide, bis(2-hydroxybutyl) sulphide, bis(2-hydroxypentyl) sulphide, and mixtures thereof. In still another embodiment, the polyether sulphide compound may also include disulphides such as for example alkoxylates of dithiodiglycol and mixtures of disulphides.

The concentration of the polyether sulphide compound, component (ii), present in the antioxidant package of the present invention may range generally from about 1 wt % to about 99 wt % in one embodiment, and from about 5 wt % to about 95 wt % in another embodiment, from about 10 wt % to about 90 wt % in yet another embodiment and from about 50 wt % to about 90 wt % in still another embodiment, based on the total weight of the components in the antioxidant package.

In another embodiment, the antioxidant composition of the present invention includes a weight ratio of the hindered phenolic to the polyether sulphide of from about 10:1 to about 1:10. In an additional embodiment, the antioxidant composition of the present invention includes a weight ratio of the hindered phenolic to the polyether sulphide of from about 5:1 to about 1:1.

The polyether sulphide compound, component (ii), provides the antioxidant package of the present invention with several benefit(s) including, for example, the functionality of the polyether sulphide to act as an anti-oxidant booster to the hindered phenolic antioxidant. The polyether sulphide compound can also improve the detergency properties of the lubricant. The polyether sulphide is a low-viscosity oil and can also improve handling of the antioxidant package. Typically, the viscosity of the polyether sulphide can be from about 30 centistokes (cSt) to about 150 cSt when measured using the procedure described in ASTM D445 (2015) at 40° C.

The antioxidant package of the present invention may also include various other components, adjuvants, or additives including for example one or more of corrosion inhibitors, viscosity modifiers, emulsifiers, demulsifiers, dispersants, detergents, anti-wear additives, lubricity additives and extreme pressure additives, and mixtures thereof. The antioxidant package may also contain a solvent such as a mineral oil, glycol ether, ester, polyalkylene glycol, and mixtures thereof to improve ease of handling the antioxidant package.

The concentration of the optional additives added to the antioxidant package of the present invention may range generally from 0 wt % to about 95 wt % in one embodiment, from about 0.01 wt % to about 50 wt % in another embodiment, and from about 0.1 wt % to about 20 wt % in still another embodiment, based on the total weight of the components in the antioxidant package.

The optional additives, component (iii), may be added to the antioxidant package to provide the antioxidant package with the function of said additives and several benefit(s). For example, corrosion inhibitors will provide ferrous and non-ferrous corrosion inhibition functionality of the final lubricant composition to which the additive package is added. Viscosity modifiers can improve the viscosity index of the final lubricant composition to which the additive package is added. Solvents can improve low temperature properties of the anti-package and the final lubricant composition to which the additive package is added. Demulsifiers can improve the demulsification of the final lubricant composition to which the additive package is added. Antiwear and extreme pressure additives can improve the antiwear and extreme pressure properties of the final lubricant composition to which the additive package is added. Lubricity additives can improve the friction control properties of the final lubricant composition to which the additive package is added.

In a broad embodiment, the process of preparing the antioxidant package of the present invention includes blending or mixing the above components (i) and (ii) together and optionally component (iii), to form the antioxidant package.

The process and type of equipment used to prepare the antioxidant package of the present invention includes blending or mixing of the above components in conventional mixing equipment or vessels known in the art. For example, the preparation of the antioxidant package of the present invention is achieved by blending, in known mixing equipment, components (i) and (ii) and optionally (iii) any other desirable additives. The preparation of the antioxidant package of the present invention, and/or any of the steps thereof, may be a batch or a continuous process.

All the above compounds of the antioxidant package are typically mixed and dispersed in a vessel at a temperature enabling the preparation of an effective antioxidant package. For example, the temperature during the mixing of the above components may be generally from about 20° C. to about 80° C. in one embodiment and from about 25° C. to about 50° C. in another embodiment.

In one embodiment, the process of preparing an antioxidant package of the present invention includes, for example, the steps of: (a) loading a vessel with the polyether sulphide; (b) adding the hindered phenolic to the vessel to form a mixture in the vessel; (c) stirring the mixture at from about 25° C. to about 50° C. for about 15 minutes (min) until the mixture in the vessel is homogeneous; and (d) allowing the resulting homogeneous mixture to cool to room temperature (about 23-25° C.).

Optionally, after step (c) above, one or more of the optional additives described above may be added to the mixture in the vessel. The mixture is then stirred further for about 30 min at from about 25° C. to about 80° C. until the mixture in the vessel is clear and homogeneous to the visual eye.

The antioxidant package of the present invention prepared by the above process exhibits several unexpected and unique properties; and imparts several improvements to the lubricant composition. One of the main important properties of the antioxidant package is to provide anti-oxidancy to the lubricant composition. Other properties exhibited by the antioxidant package can include for example lubricity, solvency, detergency, demulsification, emulsification, antiwear, and extreme pressure performance properties.

Generally, the antioxidant capability property of the antioxidant package can be measured and compared to a control sample that contains the same treat level of the hindered phenolic but does not contain a polyether sulphide; or the same level of the polyether sulphide but does not contain the hindered phenolic. The method used to measure anti-oxidant performance in a modified ASTM D2893 (Method B). In this test the modifications are such that the time of the test is extended and samples of the fluid are taken after 3, 7, 14, 20, 27, 34, 41, 48, 55, 62 and 69 days and optionally every 7 days thereafter up to about 153 days and their total acid numbers (TAN) are measured using ASTM D664-11. When the TAN value has risen by 2.0 mgKOH/g above its initial value the fluid has reached its end point and the time recorded.

Another beneficial property of the antioxidant package of the present invention is its capability of providing the lubricant composition with an extended operating life. The life of the lubricant can be extended by the antioxidant package. The extended life of the lubricant composition can be correlated to the increase (as a percentage) of the thermo-oxidative stability property of the lubricant composition containing at least one polyether sulphide compared to a lubricant composition without containing the at least one polyether sulphide. The percent increase of the thermo-oxidative stability property of a lubricant composition of the present invention can be about 100% or greater in one embodiment, about 200% or greater in another embodiment, and about 300% or greater in yet another embodiment. Alternatively, the percent increase of the thermo-oxidative stability property of the lubricant composition of the present invention can be in the range of from about 100% to about 400% in one embodiment and from about 100% to about 200% in another embodiment. The life of the lubricant provided by the antioxidant package can be determined using the procedure as described in a modified version of ASTM D2893B which is described herein below.

One broad embodiment of the present invention includes a lubricant composition useful as a lubricating oil for applications such as automobile oils. For example, the lubricant composition includes in combination: (a) the antioxidant package of the present invention described above which comprises (i) at least one hindered phenolic antioxidant, and (ii) at least one polyether sulphide; and (b) at least one base oil.

In preparing the lubricant composition of the present invention, a first required component (a) includes the antioxidant package of the present invention described above which comprises (i) at least one hindered phenolic antioxidant, and (ii) at least one polyether sulphide.

The concentration of the antioxidant package, component (a), in the lubricant composition of the present invention may range generally from about 0.05 wt % to about 50 wt % in one embodiment, and from about 0.5 wt % to about 25 wt % in another embodiment, and from about 1 wt % to about 10 wt % in still another embodiment, based on the total weight of the components in the lubricant composition.

In one embodiment, the hindered phenolic antioxidant can be present in the lubricant composition at a concentration of from about 0.01 wt % to about 10 wt % in one embodiment and from about 0.5 wt % to about 5 wt % in another embodiment.

In one embodiment, the S-PAG can be present in the lubricant composition at a concentration of from about 0.05 wt % to about 25% in one embodiment and from about 1 wt % to about 5 wt %.

As described above the antioxidant, component (a), provides to the lubricant composition of the present invention the following benefit(s), for example, long life and detergency.

In preparing the lubricant composition of the present invention, a second required component (b) includes at least one base oil. In general, the base oil can be any API Group I, II, III, IV or V base oil. Group I, II and III base oils are hydrocarbon oils. Group IV base oils are polyalphaolefins (synthetic hydrocarbons). Group V base oils include all other synthetic base oils such as polyalkylene glycols and esters.

Examples of Group V base oils are SYNALOX 100-30B and UCON OSP-46. In one general embodiment, conventional polyalkylene glycols (Group V) base oils are used in the present invention. For example, one embodiment includes a butanol initiated propoxylate (SYNALOX 100-30B) and another embodiment includes an oil soluble polyalkylene glycol such as a dodecanol initiated PO/BO copolymer (UCON OSP-46). Examples of the Group V base oils useful in the present invention are further described in Table I. Examples of the invention in a Group IV (PAO) hydrocarbon base fluid are also shown.

TABLE I

Description of Base Oils

| BASE OILS | CHEMISTRY | SUPPLIER |
|---|---|---|
| UCON ™ OSP-46 | Dodecanol initiated random copolymer of 1,2-propylene oxide (PO) and 1,2-butylene oxide (BO) (PO/BO, 50/50 by wt) with a typical kinematic viscosity at 40° C. of 46 $mm^2/s$ (cSt). Its average molecular weight is 1,000 grams/mole (g/mol) and viscosity index is 164. | The Dow Chemical Company |

TABLE I-continued

Description of Base Oils

| BASE OILS | CHEMISTRY | SUPPLIER |
|---|---|---|
| SYNALOX 100-30B | Butanol initiated 1,2-propylene oxide (PO) homo-polymer with a typical kinematic viscosity at 40° C. of 46 $mm^2/s$ (cSt). Its average molecular weight is 850 g/mol and viscosity index is 190. | The Dow Chemical Company |
| SYNFLUID PAO-5 | Polyalphaolefin with a typical kinematic viscosity at 100° C. of 5.2 $mm^2/s$ (cSt), a typical kinematic viscosity at 40° C. of 25 $mm^2/s$ (cSt) and a typical pour point (ASTM D97) of −46° C. | Chevron Phillips |

The concentration of the base oil, component (b), present in the lubricant composition of the present invention may be at about >50% by weight in one embodiment, and generally is in the range of from about >50 wt % to about 99.5 wt % in another embodiment, from about 70 wt % to about 98 wt % in still another embodiment, and from about 90 wt % to about 95 wt % in yet another embodiment, based on the total weight of the components in the lubricant composition.

The base oil, component (b), of the lubricant composition provides several benefit(s) to the lubricant composition including, for example, the base oil provides the lubricant composition with the desired viscosity, viscosity index, and low temperature properties; and the base oil acts as a carrier fluid for the additive package.

The lubricant composition of the present invention containing a base oil, a hindered phenolic and a polyether sulphide may also include other optional components or additives including for example one or more of other base oils, other hindered phenolic antioxidants, other polyether sulphides, viscosity index improvers, corrosion inhibitors, yellow metal passivators, foam control agents, extreme pressure additives, anti-wear additives, friction modifiers, pour point depressants, dyes; and mixtures thereof. The lubricant composition of the present invention can also contain other anti-oxidants such as the aminic types, for example, alkylated diphenylamines (ADPA).

The concentration of the optional additives added to the lubricant composition of the present invention may range generally from 0 wt % to about 25 wt % in one embodiment, from about 0.01 wt % to about 15 wt % in another embodiment, and from about 0.1 wt % to about 5 wt % in still another embodiment, based on the total weight of the components in the lubricant composition.

The optional additive, component (c), may be added to the lubricant composition to provide the lubricant composition with the following benefit(s): For example, corrosion inhibitors will provide ferrous and non-ferrous corrosion inhibition functionality. Viscosity modifiers can improve the viscosity index of the composition. Solvents can provide improved low temperature properties of the lubricant composition. Demulsifiers can provide improved demulsification of the composition. Antiwear and extreme pressure additives can improve the antiwear and extreme pressure properties of the composition. Lubricity additives can improve the friction control properties of the lubricant composition.

In a broad embodiment, the process of preparing the lubricant composition of the present invention includes blending or mixing the above components (a) and (b) together to form the lubricant composition.

The process and type of equipment used to prepare the lubricant composition of the present invention includes blending or mixing of the above components in conventional mixing equipment or vessels known in the art. For example, the preparation of the lubricant composition of the present invention is achieved by blending, in known mixing equipment, components (a) and (b) and optionally (c) any other desirable additives. The preparation of the lubricant composition of the present invention, and/or any of the steps thereof, may be a batch or a continuous process.

All the above compounds of the lubricant composition are typically mixed and dispersed in a vessel at a temperature enabling the preparation of an effective lubricant composition. For example, the temperature during the mixing of the above components may be generally from about 20° C. to about 100° C. in one embodiment, and from about 25° C. to about 60° C. in another embodiment.

In one embodiment, the process of preparing a lubricant composition of the present invention includes, for example, the steps of (a) adding a base oil to a vessel; (b) adding the additive package described above to the vessel to form a mixture; (c) stirring the mixture in the vessel and heating the vessel to about 50° C. for about 1 hour (hr) until the resulting composition in the vessel is clear and homogeneous; and (d) cooling the vessel and contents to ambient temperature (about 25° C.).

In another embodiment, the process of preparing a lubricant composition of the present invention includes, for example, the steps of (a) adding a base oil to a vessel; (b) adding the polyether sulphide while stirring at from about 20° C. to about 50° C. until the mixture in the vessel is clear and homogeneous; (c) adding the hindered phenolic antioxidant while stirring at a temperature of from about 20° C. to about 50° C. until the resulting composition is clear and homogeneous; and (d) cooling the resultant composition to ambient temperature.

In another embodiment, the process of preparing the lubricant composition of the present invention includes preparing oil soluble S-PAGs using 1,2-butylene oxide as a building block and reacting with a thiodiglycol to a range of molecular weights. For example, the molecular weight of the S-PAG can be in the range of from about 250 g/mol to about 5,000 g/mol in one embodiment, from about 400 g/mol to about 2,000 g/mol in another embodiment, and from about 500 g/mol to about 1,000 g/mol in still another embodiment. The molecular weight of the S-PAG may be measured by the procedure described in ASTM D4274-16 (standard test method for testing polyurethane raw materials: Determination of Hydroxyl Numbers of Polyols).

Generally, the thermo-oxidative stability performance property of the lubricant composition can be extended by 100% or more over the control sample when the compositions are evaluated versus the modified ASTM D2893 (Method B) test described earlier.

Because of the beneficial properties exhibited by the antioxidant package and the lubricant composition or formulation, the lubricant composition of the present invention is advantageously used in applications where oils are used including for example: automobile oils such as engine oils, transmission fluids, and industrial oils such a compressor fluids, gear oils, hydraulic fluids and greases.

EXAMPLES

The following Examples and Comparative Examples further illustrate the present invention in more detail but are not to be construed to limit the scope thereof.

In the following Examples and Comparative Examples, various terms and designations were used and are explained as follows:

"ASTM" stands for American Society for Testing and Materials.

ASTM D7042 is used to calculate kinematic viscosity.

ASTM D2270 is used to calculate viscosity index.

ASTM D4274-05 is used to measure hydroxyl number.

General Blending Procedure

Tables II, III and IV below describe compositions that were prepared according to the following procedure.

To a 1,000 mL glass beaker was added each blend component in the weight percentages shown such that the total weight of the mixture was 500 g. The mixture was stirred under mild heat (e.g., up to a temperature of 50° C. maximum) and the stirring yielded a clear homogeneous solution. Examples of the compositions of the present invention are designated as "Examples" or abbreviated as "Ex"; and comparative examples are designated as "Comparative Examples" or abbreviated as "Comp. Ex".

Syntheses of Polyether Sulphides

General Synthesis Procedure 1 for Synthesis of S-PAG-PO (PO Derivative of Thiodiglycol)

In this General Synthesis Procedure 1, 1,190 grams (g) of 2,2'-thiodiethanol is loaded into a 10,000 mL stainless steel alkoxylation reactor, equipped with a stirrer, an alkylene oxide dosing system, a temperature control system, and a means to apply a vacuum. To the 2,2'-thiodiethanol in the reactor is added 26.5 g of a 45% aqueous KOH solution as a catalyst. The reactor is closed and the air in the reactor is replaced with nitrogen. Next, the reactor is heated to 115° C. at which temperature the water present in the reaction mixture is removed (to a level of <3,000 parts per million [ppm]) by applying a vacuum to the reactor at 30 millibars (mbar) for 120 min. Once the vacuum is completed, the reactor is further heated to 130° C. At the temperature of 130° C., a total of 4,750 g propylene oxide (PO) is added to the reactor over 6 hours (hr) until a target kinematic viscosity (e.g., 46 cSt at 40° C.) is reached. Once the entire PO has been added to the reactor, the oxide feed is stopped and the reactor is kept at 130° C. for 6 hr to allow the remaining propylene oxide to react away. The resulting polyglycol is treated with magnesium silicate and filtered to remove the catalyst.

The resultant product prepared by the process above has a kinematic viscosity at 40° C. of 45.8 cSt, (ASTM D7042) a kinematic viscosity at 100° C. of 6.96 cSt (ASTM D7042), a viscosity index of 109 (ASTM D2270) and a hydroxyl number of 188.0 mg KOH/g (ASTM D4274-05). The resultant product's practical molecular weight by hydroxyl number determination is about 600 g/mol (as measured using ASTM D4274-(2016).

General Synthesis Procedure 2 for Synthesis of S-PAG-BO-1 (BO Derivative of Thiodiglycol)

In this General Synthesis Procedure 2, 582 g of 2,2'-thiodiethanol is loaded into a 10,000 mL stainless steel alkoxylation reactor, equipped with a stirrer, an alkylene oxide dosing system, a temperature control system and a means to apply vacuum. To the 2,2'-thiodiethanol is added 13.9 g of a 45% aqueous KOH solution as a catalyst. The reactor is closed and the air in the reactor is replaced with nitrogen. Next, the reactor is heated to 115° C. at which temperature the water present in the reaction mixture is removed (to a level of <3,000 ppm) by applying a vacuum to the reactor at 30 mbar for 120 min. Once the vacuum is completed, the reactor is further heated to 130° C. At the temperature of 130° C., a total of 2,514 g 1.2 butylene oxide (BO) is added over 6 hr until a target kinematic viscosity (e.g., 46 cSt at 40° C.) is reached. Once the entire BO has been added to the reactor, the oxide feed is stopped and the reactor is kept at 130° C. for 6 hr to allow the remaining butylene oxide in the reactor to react away. The resulting polyglycol is treated with magnesium silicate and filtered to remove the catalyst.

The resultant product has a kinematic viscosity at 40° C. of 50.7 cSt, a kinematic viscosity at 100° C. of 6.80 cSt, a viscosity index of 84, and a hydroxyl number of 179.0 mg KOH/g. The resultant product's practical molecular weight by hydroxyl number determination is about 630 g/mol (as measured using ASTM D4274-(2016).

General Synthesis Procedure 3 for Synthesis of S-PAG-BO-2 (BO Derivative of Thiodiglycol)

The procedure is the same as for S-PAG-BO-1 except 709.5 grams of thiodiglycol, 4756 grams of 1,2-butylene oxide were used and aqueous potassium hydroxide catalyst (45%) (1925 ppm KOH end batch) to produce a material with a kinematic viscosity at 40° C. of 80.5 cSt, a kinematic viscosity at 100° C. of 10.1 cSt, a viscosity index of 106, and a hydroxyl number of 119 mg KOH/g. The resultant product's practical molecular weight by hydroxyl number determination is 940 g/mol (as measured using ASTM D4274-(2016).

General Synthesis Procedure 4 for Synthesis of S-PAG-BO-3 (BO Derivative of Thiodiglycol)

The procedure is the same as for S-PAG-BO-1 except 351 grams of thiodiglycol, 7399 grams of 1,2-butylene oxide were used and aqueous potassium hydroxide (45%) catalyst (1894 ppm end batch) to produce a material with a kinematic viscosity at 40° C. of 213 cSt, a kinematic viscosity at 100° C. of 25 cSt, a viscosity index of 148, and a hydroxyl number of 52.5 mg KOH/g. The resultant product's practical molecular weight by hydroxyl number determination is 2140 g/mol (as measured using ASTM D4274-(2016).

Oxidation Testing

ASTM D2893-04 (2009), "Standard Test Method for Oxidation Characteristics of Extreme-Pressure Lubrication Oils", was used in testing the Examples and Comparative Examples herein except that the ASTM D-2893B test method was modified slightly. The two modifications made to the test method were (1) the test time and (2) the method of measuring the ageing of the lubricant test sample. For example, the test time according to the ASTM D-2893B test method is 13 days. In the examples of the present invention, a test time of up to 153 days was used. In accordance with the ASTM D-2893B test method, the ageing of the lubricant test sample is measured by the viscosity change of the fluid (lubricant) before and after the 13 days test time. In the examples of the present invention, viscosity changes were not measured; but instead, the total acid number change of the lubricant was measured. The modified ASTM D-2893B test method used is further described in more detail in the following Examples and Comparative Examples:

Examples 1-4 and Comparative Example A

The lubricant compositions used in these examples are described in Table II which describes a base oil content and an anti-oxidant package content; and the results of the test performed in the examples.

The apparatus used in these examples is accurately described in the ASTM D2893 (2009) Method B. The test lubricant composition (300 mL) is placed in a borosilicate glass tube and heated to 121° C. in dry air. The method of ASTM D2893 asks for the viscosity change to be recorded after 13 days. However, in the present examples, a modified ASTM D2893 method was used, that is, tracking the ageing of the lubricant was used in the present examples since polyethers show ageing changes usually through total acid number (TAN) changes versus viscosity changes. Accordingly, the TAN was measured initially. Then, the TAN was measured after 3 days, 7 days, and 14 days; and thereafter, about every 7 days by removing a 5 mL sample from a glass tube containing the lubricant sample and using the method described in ASTM D664 (2011) to test the 5 mL sample. When the total acid number increased by >2.0 mg KOH/g above the initial value, the lubricant composition is considered to have reached an ageing threshold where the composition was deemed to be no longer useful; and the time (in days) to reach that TAN threshold was recorded. The results from testing the examples are described in Table II.

For some robust formulations (lubricant compositions), the testing of these examples was stopped before the TAN value had increased by >2 mg KOH/g. The results of these examples are noted in Table II with a greater than (>) number of days result.

TABLE II

| Example No. | Base Oil (wt %) | Anti-Oxidant Package (wt %) | Initial TAN Value (mg KOH/g) | Time to TAN Increase of 2 mg KOH/g (days) |
|---|---|---|---|---|
| Comp. Ex. A | UCON OSP-46 (99.5%) | Irganox L135 (0.5%) | 0.05 | 14 |
| Ex. 1 | UCON OSP-46 (94.5%) | S-PAG-PO (5%)<br>Irganox L135 (0.5%) | 0.05 | 48 |
| Ex. 2 | UCON OSP-46 (98.5%) | S-PAG-PO (1%)<br>Irganox L135 (0.5%) | 0.05 | 41 |
| Ex. 3 | UCON OSP-46 (94.5%) | S-PAG-BO-1 (5%)<br>Irganox L135 (0.5%) | 0.05 | >69* |
| Ex. 4 | UCON OSP-46 (98.5%) | S-PAG-BO-1 (1%)<br>Irganox L135 (0.5%) | 0.05 | 27 |

*TAN value increase was < 2.0 mg KOH/g after the time period shown

Table II describes the results of oxidative testing of lubricant compositions wherein the base oil is UCON OSP-46, an oil soluble polyalkylene glycol (PO/BO copolymer), and wherein the anti-oxidant package includes a hindered phenolic anti-oxidant (Irganox L135) combined with an anti-oxidant performance booster. Two different types of polyether sulphides, S-PAG-PO (Examples 1 and 2) and S-PAG-BO-1 (Examples 3 and 4) are described in Table II as the anti-oxidant performance boosters used. Table II describes examples of the boost in anti-oxidant performance that can be achieved when a hindered phenolic anti-oxidant (Irganox L135) is combined with either S-PAG-PO or S-PAG-BO-1 compared to using a hindered phenolic anti-oxidant alone (Comparative Example A).

The results in Table II show that lubricant compositions of the present invention containing a hindered phenolic anti-oxidant when treated with S-PAGs at levels of 1% and 5% generally performed better than lubricant compositions without the treatment of S-PAGs.

TABLE III

Examples Using a PO Homo-Polymer

| Example No. | Base Oil (wt %) | Anti-Oxidant Package (wt %) | Initial TAN Value (mg KOH/g) | Time to TAN Increase of 2 mg KOH/g (days) |
|---|---|---|---|---|
| Comp. Ex. B | SYNALOX 100-30B (99.5%) | Irganox L135 (0.5%) | 0.05 | 7 |
| Ex. 5 | SYNALOX 100-30B (94.5%) | S-PAG-PO (5%)<br>Irganox L135 (0.5%) | 0.04 | 27 |
| Ex. 6 | SYNALOX 100-30B (98.5%) | S-PAG-PO (1%)<br>Irganox L135 (0.5%) | 0.04 | 20 |
| Ex. 7 | SYNALOX 100-30B (94.5%) | S-PAG-BO-1 (5%)<br>Irganox L135 (0.5%) | 0.04 | 14 |
| Ex. 8 | SYNALOX 100-30B (98.5%) | S-PAG-BO-1 (1%)<br>Irganox L135 (0.5%) | 0.04 | 14 |

Table III describes the results of oxidative testing of lubricant compositions wherein the base oil is SYNALOX 100-30B, a conventional polyalkylene glycol (PO homo-polymer), and wherein the anti-oxidant package includes a hindered phenolic anti-oxidant (Irganox L135) combined with an anti-oxidant performance booster. Two different types of polyether sulphides, S-PAG-PO (Examples 5 and 6) and S-PAG-BO-1 (Examples 7 and 8) are described in Table III as the anti-oxidant performance boosters used. Table III describes examples of the boost in anti-oxidant performance that can be achieved when a hindered phenolic anti-oxidant (Irganox L135) is combined with either S-PAG-PO or S-PAG-BO-1 compared to using a hindered phenolic anti-oxidant alone (Comparative Example B).

The results in Table III show that lubricant compositions of the present invention containing a hindered phenolic anti-oxidant when treated with S-PAGs at levels of 1% and 5% generally performed better than lubricant compositions without the treatment of S-PAGs.

Table IV describes the results of oxidative testing of lubricant compositions wherein the base oil is a hydrocarbon base oil (polyalphaolefin). The anti-oxidant package includes a hindered phenolic anti-oxidant (Irganox L135) combined with an anti-oxidant performance booster. Three different types of polyether sulphides, S-PAG-BO-1 (Examples 9 and 10), S-PAG-BO-2 (Examples 11 and 12) and S-PAG-BO-3 (Examples 13 and 14) are described in Table IV as the anti-oxidant performance boosters used. Each booster has a different viscosity and molecular weight. Table IV shows examples of the boost in anti-oxidant performance that can be achieved when a hindered phenolic anti-oxidant (Irganox L135) is combined with either S-PAG-BO-1, S-PAG-BO-2 or S-PAG-BO-3 compared to using a hindered phenolic anti-oxidant alone (Comparative Example C). In the absence of an anti-oxidant booster (Comparative Ex C) the fluid failed the test after 153 days. In the presence of the S-PAG-BO polymers the compositions exceeded 153 days. To illustrate how effective the inclusion of an S-PAG-BO additive is, the final TAN value is shown in Table IV. Final TAN values of between 0.18 and 0.27 mg KOH/g were obtained for those compositions (Ex 9-14) suggesting very minor oxidation has occurred when the booster is present.

The results in Table IV show that lubricant compositions of the present invention containing a hindered phenolic anti-oxidant when treated with S-PAG-BO polymers at

TABLE IV

Examples using a synthetic hydrocarbon base oil (PAO)

| Example No. | Base Oil (wt %) | Anti-Oxidant Package (wt %) | Initial TAN Value (mg KOH/g) | Final TAN Value (mg KOH/g) | Time to TAN Increase of 2 mg KOH/g (days) |
|---|---|---|---|---|---|
| Comp. Ex. C | PAO-5 (99.5%) | Irganox L135 (0.5%) | 0.07 | 31.5 | 153 |
| Ex. 9 | PAO-5 (99.0%) | S-PAG-BO-1 (0.5%)<br>Irganox L135 (0.5%) | 0.06 | 0.24 | >153 |
| Ex. 10 | PAO-5 (99.4%) | S-PAG-BO-1 (0.1%)<br>Irganox L135 (0.5%) | 0.07 | 0.25 | >153 |
| Ex. 11 | PAO-5 (99.0%) | S-PAG-BO-2 (0.5%)<br>Irganox L135 (0.5%) | 0.07 | 0.22 | >153 |
| Ex. 12 | PAO-5 (99.4%) | S-PAG-BO-2 (0.1%)<br>Irganox L135 (0.5%) | 0.07 | 0.27 | >153 |
| Ex. 13 | PAO-5 (99.0%) | S-PAG-BO-3 (0.5%)<br>Irganox L135 (0.5%) | 0.07 | 0.18 | >153 |
| Ex. 14 | PAO-5 (99.4%) | S-PAG-BO-3 (0.1%)<br>Irganox L135 (0.5%) | 0.07 | 0.21 | >153 |

levels of 0.1% and 0.5%, performed better than a lubricant composition without an anti-oxidant booster.

What is claimed is:

1. An antioxidant package composition comprising a combination of: (i) at least one hindered phenolic antioxidant, and (ii) at least one polyether sulphide derived from an alkoxylate derivative of thiodiglycol.

2. The composition of claim 1, wherein the hindered phenolic is benzenepropanoic acid, 3,5-bis(1,1-dimethylethyl)-4-hydroxy-,C7-9-branched alkyl esters.

3. The composition of claim 1, wherein the polyether sulphide is derived from a propoxylate derivative of thiodiglycol.

4. The composition of claim 1, wherein the polyether sulphide is derived from a butoxylate derivative of thiodiglycol.

5. The antioxidant composition of claim 1, wherein the concentration of the hindered phenolic in the antioxidant package composition is from about 0.01 weight percent to about 20 weight percent.

6. The antioxidant composition of claim 1, wherein the concentration of the polyether sulphide in the antioxidant package composition is from about 10 weight percent to about 90 weight percent.

7. The antioxidant composition of claim 1, wherein the weight ratio of the hindered phenolic to the polyether sulphide is from about 10:1 to about 1:10.

8. A lubricant composition comprising:

(a) at least one base oil, (b) at least one hindered phenolic antioxidant, and (c) at least one polyether sulphide derived from an alkoxylate derivative of thiodiglycol.

9. The lubricant composition of claim 8, wherein the base oil is a polyalkylene glycol.

10. The lubricant composition of claim 8, wherein the base oil is an oil soluble polyalkylene glycol.

11. The composition of claim 8, wherein the base oil is a hydrocarbon base oil.

12. The lubricant composition of claim 8, wherein (a) the base oil is a polyalkylene glycol, (b) the hindered phenolic is benzenepropanoic acid, 3,5-bis(1,1-dimethylethyl)-4-hydroxy-,C7-9-branched alkyl esters, and (c) the polyether sulphide is a propoxylate derivative of thiodiglycol.

13. The lubricant composition of claim 8, wherein the concentration of the antioxidant package in the lubricant composition is from about 0.05 weight percent to about 25 weight percent.

14. The lubricant composition of claim 8, wherein the concentration of the base oil in the lubricant composition is from about 70 weight percent to about 99.95 weight percent.

15. The lubricant composition of claim 8, wherein the thermo-oxidative stability property of the lubricant composition is increased compared to the composition of claim 11 without the at least one polyether sulphide; wherein the percent increase of the thermo-oxidative stability of the lubricant is greater than about 50 percent; and the thermo-oxidative stability is measured by modified Method B of ASTM D2893.

16. A process for preparing a lubricant composition comprising admixing:

(a) at least one base oil, (b) at least one hindered phenolic antioxidant, and (c) at least one polyether sulphide derived from an alkoxylate derivative of thiodiglycol.

17. The process of claim 16, wherein the process is carried out at a temperature of from about 25° C. to about 100° C. with stirring at from about 15 minutes to about 1 hour.

* * * * *